US005354134A

United States Patent [19]

Patry

[11] Patent Number: 5,354,134

[45] Date of Patent: Oct. 11, 1994

[54] DEVICE FOR REGISTERING THE OPERATIONS OF A THERMAL TRANSFER PRINTER

[75] Inventor: Bernard Patry, Orsay, France

[73] Assignee: Axiohm, Montrouge, France

[21] Appl. No.: 77,107

[22] Filed: Jun. 16, 1993

[30] Foreign Application Priority Data

Jun. 24, 1992 [FR] France ..... 92 07726
Apr. 21, 1993 [FR] France ..... 93 04683

[51] Int. Cl.[5] ..... B41J 3/42; B41J 35/28

[52] U.S. Cl. ..... 400/73; 400/208; 400/236.2

[58] Field of Search ..... 400/120, 73, 582, 583.1, 400/583.3, 196, 207, 208, 208.1, 247, 248, 249

[56] References Cited

U.S. PATENT DOCUMENTS

| | | | |
|---|---|---|---|
| 4,146,338 | 3/1979 | Hedstrom | 400/249 |
| 4,797,018 | 1/1989 | Hofmann et al. | 400/249 |
| 4,895,466 | 7/1990 | Hartmann et al. | 400/73 |
| 5,067,832 | 11/1991 | Baur et al. | 400/584 |
| 5,128,763 | 7/1992 | Sakuragi | 400/208 |

FOREIGN PATENT DOCUMENTS

| | | | |
|---|---|---|---|
| 0189984 | 6/1986 | European Pat. Off. . | |
| 1208748 | 1/1966 | Fed. Rep. of Germany . | |
| 1152838 | 4/1967 | Fed. Rep. of Germany . | |
| 3109299 | 1/1982 | Fed. Rep. of Germany | 400/208 |
| 3739508 | 6/1989 | Fed. Rep. of Germany | 400/208 |
| 2496009 | 6/1982 | France | 400/208 |
| 0295283 | 12/1988 | Japan | 400/208 |
| 1258025 | 12/1971 | United Kingdom . | |

OTHER PUBLICATIONS

"Cartridge with Releasable Closure" IBM Tech. Disclosure Bulletin, vol. 27, No. 12, May 1985 pp. 6883–6887.

*Primary Examiner*—Eugene H. Eickholt
*Attorney, Agent, or Firm*—Griffin Butler Whisenhunt & Kurtossy

[57] ABSTRACT

A device for registering the printing performed by a thermal transfer printer, wherein it is constituted by the film carrying the transfer ink after it has passed over the heating points of the print head and onto a film take-up spool that includes means enabling it to be coupled to a drive member synchronized with a drive member for driving the print medium.

5 Claims, 2 Drawing Sheets

DEVICE FOR REGISTERING THE OPERATIONS OF A THERMAL TRANSFER PRINTER

The present invention relates to a device for registering printing performed by a thermal printer that operates by transferring ink onto a print medium.

BACKGROUND OF THE INVENTION

In the field of cash registers, the printing performed by a print head is commonly registered. When a dot matrix impact printer is used for printing receipts, printing is performed simultaneously on two tapes, with the impact on the first tape marking the second which is then wound up and stored to constitute a record or journal of all the transactions performed by the machine.

With a thermal printer, the problem is different since there is no impact whereby marks can be made on a secondary medium. Two media are therefore used. In a first technique, the first medium may be fine thermal paper enabling heat to be transferred to a second paper that is heat-sensitive. In another version, the first paper is heat-sensitive on its front face and forms a transfer film on its back face to transfer ink onto normal paper that constitutes the second print medium.

Using two media in, and in association with, a thermal print head always constitutes a complication. It is necessary to ensure that each medium is guided separately since the media have different destinations.

Furthermore, thermal printing by a technique in which ink is transferred from an ink-carrying film onto a medium (e.g. ordinary paper) can be adapted to printing a journal of operations only by duplicating the print head and causing the heads to print identically and simultaneously. In addition to being expensive, that technique is not guaranteed to provide an exact record of the operations performed by the printer. One of the printers may not be operating in a manner that is identical to the other, in which case their printouts may be different.

OBJECT AND SUMMARY OF THE INVENTION

The invention seeks to provide a simpler solution for obtaining a journal of the operations performed by a thermal transfer printer.

To this end, the present invention provides a device for registering the printing performed by a thermal transfer printer, which device is constituted by the film carrying the transfer ink after it has passed over the heating points of the print head and onto a film take-up spool that includes means enabling it to be coupled to a drive member synchronized with a drive member for driving the print medium.

The film carrying the transfer ink retains a transparent zone from which the ink has been taken, providing all of the ink on the film does indeed leave the film where heated to be deposited on the print medium. A negative is thus made of the positive that was indeed printed. Collecting the film thus constitutes an effective means of providing a faithful journal of the operations performed by the printer.

In a manner that is advantageous, and above all practical, for handling the transfer and registration medium, the take-up spool is constituted by a spool for taking up the ink-carrying film coming from another spool on which it is initially wound, the two spools being contained in a housing that forms a cassette. The cassette increases the ease with which the support film is installed in the printer, with which it is removed from the printer after use, and above all with which it is reused for enabling it to be read back in a device designed for that purpose.

In order to ensure that reading-back can be performed easily, either directly by eye or by else by means of a scanner or an optical reader, each of the spools in the cassette is fitted with means for coupling it to a drive member.

In this embodiment with the film in a cassette, it is advantageous for an element of the cassette housing to be fitted with an electronic "chip" so that when the cassette is installed in the machine and while it is in use it is possible to record a certain amount of information, e.g. for the purpose of identifying the machine, the clerk, or successive clerks, and to record such information relative to times of use. The electronic component may also contain instructions of a program for enabling certain members of the machine to be put into operation, and in particular the printer, thereby preventing operation with cassettes other than those specifically designed by the manufacturer for use with the machine.

To verify the record on the transfer film enclosed in a cassette, the present invention also provides a simple device comprising, in a stand, drive means including coupling members complementary to the coupling means carried by each of the spools of the cassette, and reader means situated to look at the window of the cassette when the cassette is installed on the stand.

If the cassette housing is fitted with the above-mentioned electronic "chip", it is advantageous for the device that reads back and checks the contents of the cassette to include the contacts required for reading, and more generally for communicating with the memory in said chip, thus enabling the information read back from the film to be correlated with other information, e.g. relating to conditions of use.

BRIEF DESCRIPTION OF THE DRAWINGS

Other characteristics and advantages appear from the description given below by way of example of an embodiment of the registering device and of an embodiment of the playback device.

Reference is made to the accompanying drawings, in which.

MORE DETAILED DESCRIPTION

Figure 1:
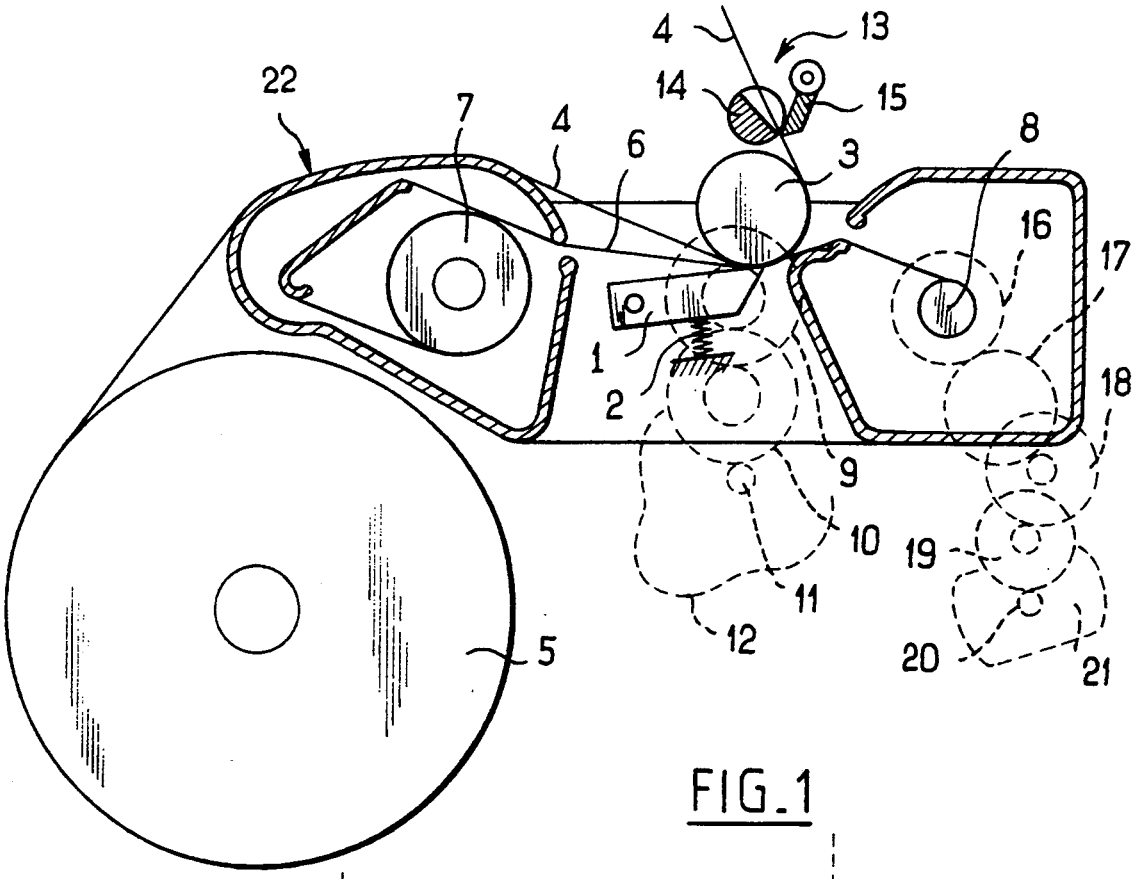
FIG. 1 is a diagrammatic section view of a thermal printer including an ink transfer film.

FIG. 1 is a fragmentary section view through the central mechanical elements of a thermal printer. Thus, it shows a print head 1 in the form of a conventional strip carrying a line of heating points, the strip being held pressed against a "capstan" roller 3 by a resilient member 2. The line of contact between the strip and the capstan is specifically the line of heating points. At this line of contact, there passes between the strip 1 and the capstan 3 both paper 4 that is to receive printing and that comes from a roll 5, and a transfer film 6 that comes from a roll 7 and that is taken up by a spool 8. The transfer film 6 is a medium for a fusible ink such that under the effect of the heat delivered by any hot heating point, the ink carried by the film 6 on its face that is in contact with the paper 4 is transferred to the paper where it then adheres on becoming detached from the film 6.

It is recalled that the paper is driven by friction against the capstan 3 which is itself rotated by a set of gears 9, 10 that form a coupling and drive system between a gear wheel secured to the capstan and the outlet shaft 11 of a motor 12.

Behind the capstan 3, the printer device generally includes a cutter device 13 for cutting the tape of paper 4 into lengths that form receipts. In conventional manner, the cutter deice comprises a rotary blade 14 and a stationary counter blade 15 between which the paper 4 passes behind the capstan 2. This figure shows neither the members for guiding the paper 4 between the capstan and the cutter device, nor the members for driving the rotary cutting blade 14, which members are under the control of the drive for the capstan.

It should finally be mentioned that the print head shown in FIG. 1 has two portions that are movable relative to each other between a position in which the members co-operate with one another as shown, and another position in which the print head is open to make it possible to install and to extract the paper medium 4 and the film 6 which are the consumables of the device. For example, there may be a first frame carrying the print head 1, the resilient member, e.g. spring 2, and the motor 12 and the associated gearing 9, 10, 11. This first frame includes means (not shown) for receiving a second frame which carries the roll 5 of paper 4, the roll 7 of transfer film 6, the spool 8 for taking up the film, the capstan 3, and the device 13.

It is thus easy to prepare the installation of the consumables (paper 4 and film 6) on the second frame and then to bring together and unite the two frames, thereby pressing the head 1 against the capstan 3 with the paper and the film sandwiched between them, and simultaneously causing the driving gear secured to the capstan to mesh with the last gear in the gearing 9, 10, 11. In general, the cutter device 13 has its own drive device that is carried by the second frame and that is caused to operate synchronously with the capstan by electronic means.

In accordance with the invention, the transfer film take-up spool 8 which is suitable for being removably associated with the second frame to recover the used transfer film includes a gear wheel 16 capable of meshing with stepdown gearing 17, 18, 19 coupled to the outlet shaft 20 of a motor 21, the gearing and the motor being carried by the first frame.

The spool 8 thus constitutes means for storing used film. It is driven synchronously with motion of the capstan 3 to ensure that there is no sliding of the transfer film 6 relative to the paper 4. More precisely, the motor 21 is a motor that is coupled to the spool 8 by slipping. It keeps the transfer film under tension, with the film being driven relative to the print head by friction against the paper 4 which is itself driven by the capstan 3.

Figure 2:
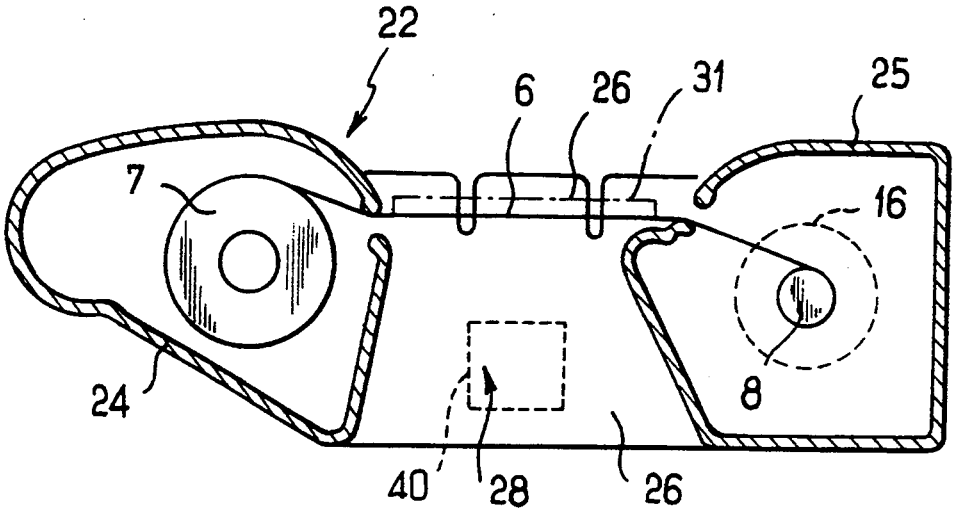
FIGS. 2 and 3 are views of a cassette of such film.
Figure 3:
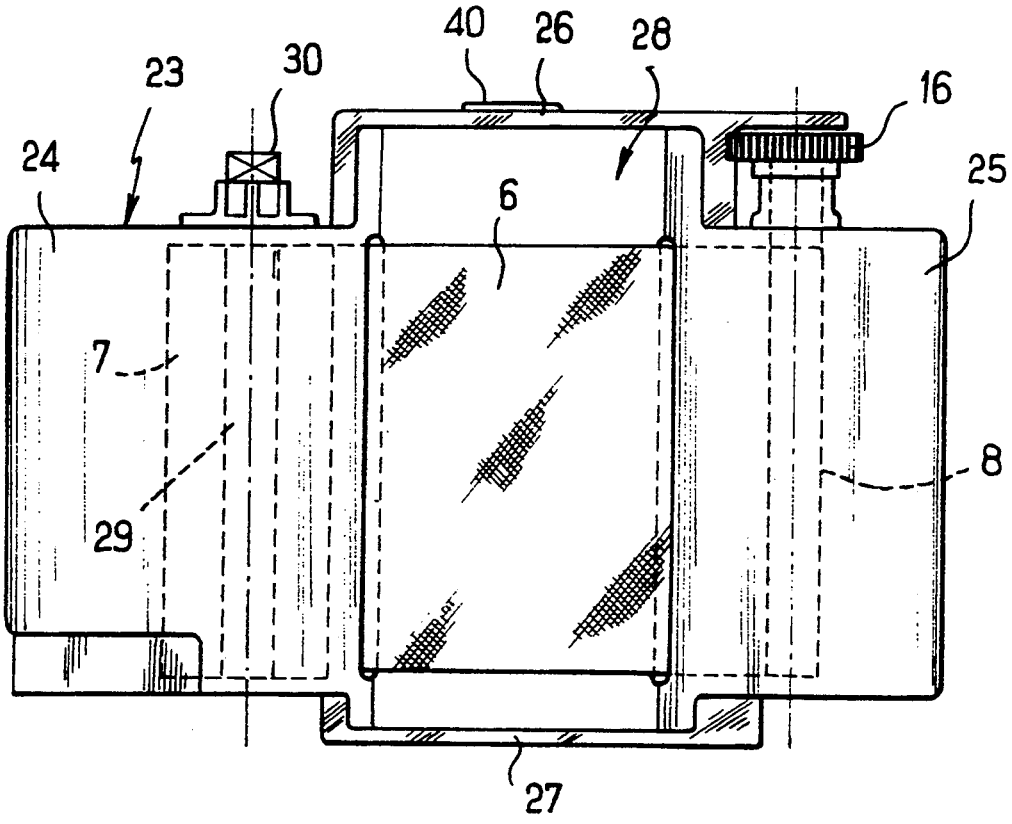

In a rudimentary embodiment of the invention, the film 6 extends from a roll 7 to a take-up spool 8 that operates synchronously with the drive imparted to the capstan. However, in a preferred embodiment of the invention, the transfer film is contained in a cassette 22. The cassette is shown in FIGS. 2 and 3. It essentially comprises a housing 23 comprising two closed portions 24 and 25 respectively containing the roll 7 of unused film 6 and the spool 8. These two portions 24 and 25 are interconnected by two arms 26 and 27 defining a window 28 between them, through which the film 6 is accessible. The film 6 occupying said window is placed in the print head.

The roll 7 is mounted on a shaft 29 which extends outside the housing 24 in the form of a coupling member (e.g. a drive square 30). Outside the portion 25, the spool 8 is fitted with a gear wheel 16 suitable for cooperating with any drive device that terminates with a complementary gear wheel, and in particular the gear wheel 17 associated with the motor 21.

Once it has been completely used up, the cassette 22 is removed from the printer. The roll 7 can be reconstituted by applying rewinding drive to the driving square 30. The film can then be examined by being run forwards by applying drive (manual or motor-driven) to the gear wheel 16. The film is examined by reading the negative on the film of the printing it has performed, either by visual inspection or by means of an optical reader. To facilitate reading, it is possible to place a support 31 for a contrast surface (e.g. a white surface) on one side of the film 6 so that it is visible through the ink-free zones of the film 6 thus making said zones more readable either to the eye or to optical reader means. The support 31 may be placed directly on the cassette between the arms 26 and 27 which are provided with snap-fastening means for engaging it. Alternatively, the support may belong to a device for checking the print operations performed by a thermal printer by examining each used cassette 22 that constitutes a journal of such operations.

Figure 4:
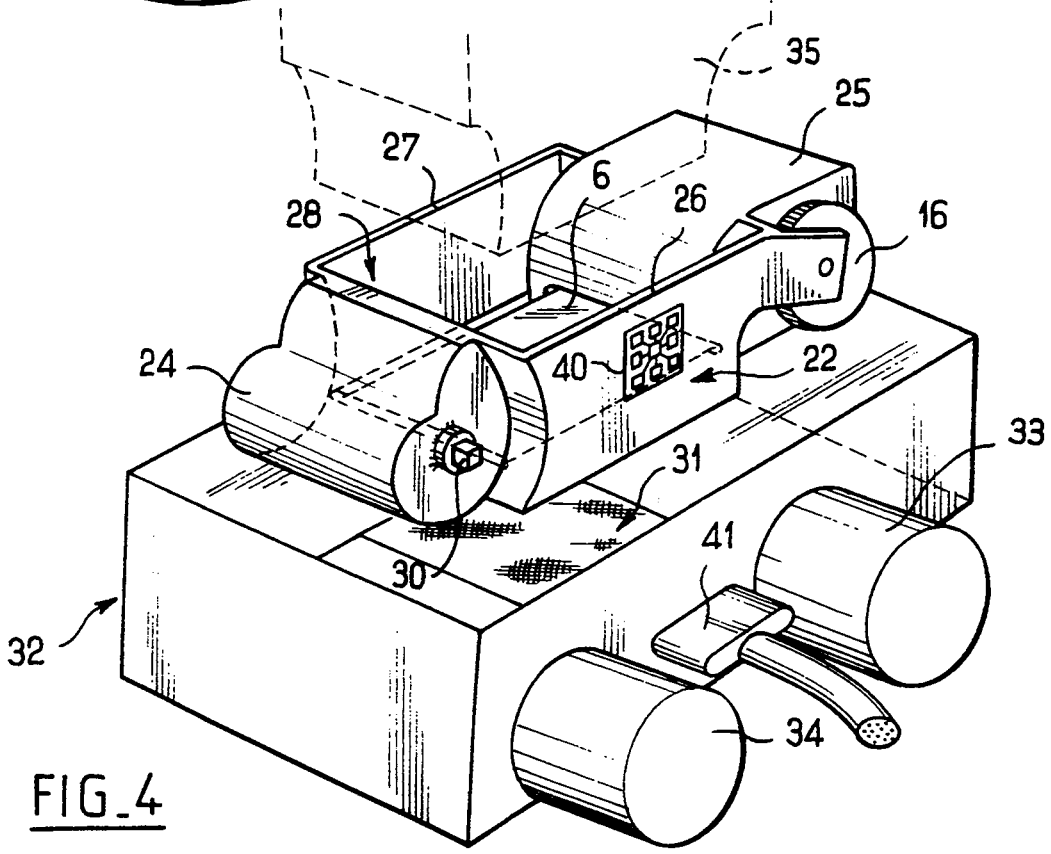
FIG. 4 is a perspective diagram of a device for checking or reading the cassette which forms a journal of printer operations.

Such a device is shown diagrammatically in FIG. 4. It comprises a stand 32 on which the cassette is installed (including appropriate keying means, not shown, for example), which stand carries motor means 33 and 34 suitable for coupling automatically with the drive elements 16 and 30 of the cassette. By controlling said means, the film 6 can be wound and rewound so that it passes in either direction through the window 28.

The stand 32 is also fitted with the support 31 for a contrast surface and it may be closed by an optical reader 35 which examines the journal constituted by the film 6. For example, the optical reader 35 may be a scanner fitted with a light source and a strip of CCD photocells enabling the information read by reflection from the surface of support 31 to be read, the light having passed through the transparent zones of the film 6. The reader may be connected to a processor unit (pattern recognizer, . . . ) enabling the journal of operations to be made use of.

In a variant embodiment, the support 31 is omitted and a digitizing reader is placed beneath the film 6, with the optical reader 35 being merely replaced by lighting means.

Finally, it may be observed in FIGS. 2, 3, and 4 that an electronic component 40 is present on one of the walls of the housing 23, e.g. on the arm 26. In conventional manner, this component or "chip" comprises a memory that is either read only, or that is electrically programmable, or that is electrically programmable and erasable, and it also includes connection elements that are accessible from the outside enabling it to be connected to power supply conductors and to conductors for interchanging information (addresses, data, . . . ). The printer and the device for reading and checking the cassette include means ready for making such a connection and for engaging in electronic dialog with the component. In FIG. 4, the stand 32 of the device is shown as having a multi-wire connector 41 for connecting said chip-engaging means on the stand 32 to a processor unit, not shown.

It is thus possible to identify the cassette, the machine in which it was used, the operator of the machine, dates and times of use, . . . on the basis of a certain amount of data written to the memory when installed and when used in the machine associated with the printer.

This information is thus available while the journal is being examined, and may constitute an advantageous supplement when processing the cassette.

In addition, the memory may contain program instructions necessary, for example, for enabling the printer to be put into operation. The microprocessor controlling the printer may be required to interrogate certain addresses in the memory carried by the cassette when it executes a program for putting the printer into operation, each time the cassette is changed. The manufacturer of the printer and of the cassette can thus protect the equipment from copying or infringement by dedicating cassettes to a printer manufactured by the same manufacturer or by an authorized manufacturer.

I claim:

1. A device for reading printing formed by a thermal transfer printer having a cassette in which a film carrying transfer ink is unwound from a first spool, passed over a heating print head and thereafter wound onto a second take-up spool, each spool including coupling means for coupling the spools to a drive member, comprising a window in the cassette between the two spools in which faces of the film are uncovered, a stand, drive means support by the stand and including coupling members complementary to the coupling means carried by each of the spools, and printing reader means situated to look at the window of the cassette when the cassette is installed on the stand.

2. A device according to claim 1, wherein the printing reader means include a contrast surface situated in correspondence with the window of the cassette.

3. A device according to claim 1, wherein the printing reader means include an optical printing reader.

4. A device according to claim 1, wherein said device is separate from the printer, such that each used cassette is usable as a journal of operations performed by the thermal printer.

5. A device according to claim 1, wherein said cassette includes a housing on which is attached an electronic component including at least one memory circuit together with electrical connection means therefor and wherein said stand includes means for electrically coupling with said connection means.

* * * * *